US011344074B2

(12) United States Patent
Cho

(10) Patent No.: US 11,344,074 B2
(45) Date of Patent: May 31, 2022

(54) SIZE ADJUSTING UNIT FOR HEADWEAR HAVING HIGH DECORATIVENESS

(71) Applicant: YUPOONG, INC., Seoul (KR)

(72) Inventor: Byoung-Woo Cho, Seoul (KR)

(73) Assignee: YUPOONG, INC., Seoul (KR)

( * ) Notice: Subject to any disclaimer, the term of this patent is extended or adjusted under 35 U.S.C. 154(b) by 319 days.

(21) Appl. No.: 15/828,662

(22) Filed: Dec. 1, 2017

(65) Prior Publication Data

US 2018/0153241 A1 Jun. 7, 2018

(30) Foreign Application Priority Data

Dec. 2, 2016 (KR) ..... 10-2016-0163635

(51) Int. Cl.
*A42B 1/24* (2021.01)
*A42B 1/22* (2006.01)
*A42C 3/00* (2006.01)

(52) U.S. Cl.
CPC ..... *A42B 1/24* (2013.01); *A42B 1/22* (2013.01); *A42C 3/00* (2013.01)

(58) Field of Classification Search
CPC .. A42B 1/002; A42B 1/22; A42B 1/24; A42B 1/004
USPC ..... 2/209.12, 195.1, 195.2, 244, 246, 243.1; D2/891, 895
See application file for complete search history.

(56) References Cited

U.S. PATENT DOCUMENTS 1,513,682 A * 10/1924 Weinstein ..... A42B 1/22 2/195.2
2,940,149 A * 6/1960 O'Connor ..... A41F 11/02 63/5.1
4,621,441 A * 11/1986 Wagner ..... G09F 3/00 36/1
5,272,772 A * 12/1993 Hahn ..... A42B 1/22 2/195.2
5,533,213 A * 7/1996 Reiner ..... A42B 1/248 2/195.2
D375,827 S * 11/1996 Will ..... D2/891
5,600,855 A * 2/1997 Ramirez ..... A42B 1/22 2/181.4
5,974,997 A * 11/1999 Amburgey ..... A41D 27/08 112/439
6,519,779 B1 * 2/2003 Taguchi ..... A42B 1/248 2/195.1
8,393,014 B1 * 3/2013 Folio ..... A42C 5/02 2/181

(Continued)

FOREIGN PATENT DOCUMENTS

KR 20-1998-0034728 9/1998
KR 20-1998-0061440 11/1998

(Continued)

*Primary Examiner* — Alissa J Tompkins
*Assistant Examiner* — Brieanna Szafran
(74) *Attorney, Agent, or Firm* — Lex IP Meister, PLLC

(57) ABSTRACT

A size adjustment unit for a headwear having high decorativeness is provided. The size adjustment unit for a headwear having high decorativeness includes: a first band including a plurality of coupling protrusions; a second band including a plurality of coupling holes arranged to correspond to the coupling protrusions; a first decorative member that is attached to an outer surface of the first band; and a second decorative member that is attached to an outer surface of the second band.

6 Claims, 5 Drawing Sheets

(56) References Cited

U.S. PATENT DOCUMENTS

| | | | | |
|---|---|---|---|---|
| 10,058,139 | B2 * | 8/2018 | Kay | A42B 1/245 |
| 10,238,161 | B1 * | 3/2019 | Ong | A42B 1/22 |
| 2012/0185996 | A1 * | 7/2012 | Goldberg | A43B 23/24 2/244 |
| 2013/0205473 | A1 * | 8/2013 | Kronenberger | A42B 1/248 2/209.13 |
| 2014/0053319 | A1 * | 2/2014 | Cho | A42B 1/248 2/209.13 |
| 2014/0245521 | A1 * | 9/2014 | Johns | A42B 1/22 2/209.13 |

FOREIGN PATENT DOCUMENTS

| | | |
|---|---|---|
| KR | 10-2014-0048757 | 4/2014 |
| WO | WO-2021051205 A1 * | 3/2021 |

* cited by examiner

SIZE ADJUSTING UNIT FOR HEADWEAR HAVING HIGH DECORATIVENESS

CROSS-REFERENCE TO RELATED APPLICATION

This application claims priority to and the benefit of Korean Patent Application No. 10-2016-0163635 filed in the Korean Intellectual Property Office on Dec. 2, 2016, the entire contents of which are incorporated herein by reference.

BACKGROUND OF THE INVENTION

(a) Field of the Invention

The present invention relates to a size adjustment unit for a headwear being capable of having various decorations with a low cost.

(b) Description of the Related Art

In general, a size adjustable headwear that may be used regardless of a head size includes a size adjustment unit.

Such a headwear size adjustment unit is produced by plastic injection molding and the production method has been typically adopted without change both in form and material since its development due to the very low production cost and the easiness of size adjustment.

When a user wears a headwear, one surface of a headwear size adjustment unit is viewed from the outside, and naturally the headwear size adjustment unit could add an ornament effect to the external appearance of the headwear. The problem is, however, that the existing headwear size adjustment unit lacks decorativeness, let alone looking fancy. Further, the injection molding limits the headwear size adjustment unit to one single color.

Accordingly, several methods have been developed to add decoration to the headwear size adjustment unit, and some use the same material as that of the headwear size adjustment unit through injection molding either together with or separately from the headwear size adjustment unit. Such methods require mold production incurring high costs, thereby being scarcely used in the industry.

Such an existing headwear size adjustment unit is inadequate to meet consumer needs for various patterns and colors.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a size adjustment unit for a headwear having high decorativeness that may be decorated in various colors or patterns with a low cost.

An exemplary embodiment of the present invention provides a size adjustment unit for a headwear having high decorativeness including: a first band including a plurality of coupling protrusions; a second band including a plurality of coupling holes arranged at a predetermined interval to correspond to the coupling protrusions; a first decorative member that is attached to an outer surface of the first band; and a second decorative member that is attached to an outer surface of the second band.

The first decorative member or the second decorative member may be made of fabric, film, leather, artificial leather, rubber, or a silicon material.

A receiving wall may be formed along a circumferential edge of an outer surface of the first band or the second band.

A height of a receiving wall formed on the first band may be generally the same as a thickness of the first decorative member.

The coupling protrusion may include a top portion and a connecting portion, the coupling hole may include an inserting portion and a receiving portion, and a length of the connecting portion may be generally the same as the sum of a depth of the inserting portion and a thickness of the first decorative member.

The first decorative member and the second decorative member may be attached to the first band and second band, respectively by sewing, ultrasonic wave bonding, or high frequency bonding.

The first band and the second band may have a sewing groove on each inner surface.

According to the present invention, a size adjustment unit for a headwear may be added with decorative elements in various colors or patterns with a low cost.

DETAILED DESCRIPTION OF THE EMBODIMENTS

For understanding of characteristics of the present invention, a size adjustment unit for a headwear having high decorativeness according to an exemplary embodiment of the present invention will be described in detail with reference to the attached drawings.

Figure 1:
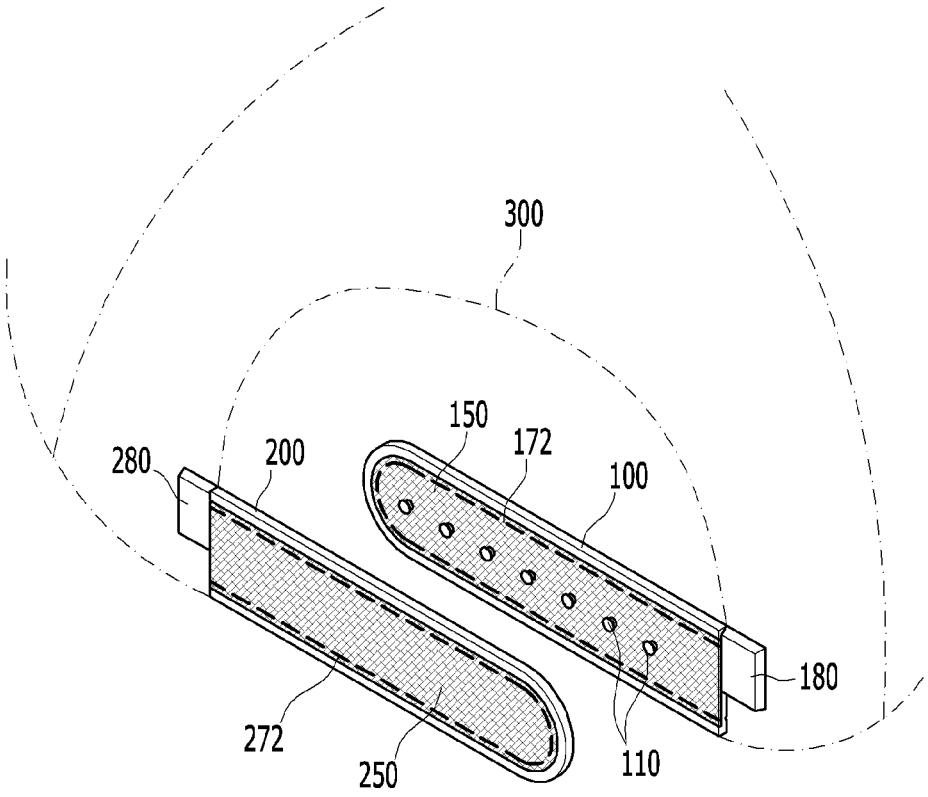
FIG. 1 is a perspective view illustrating an outer side surface of a size adjustment unit for a headwear having high decorativeness according to an exemplary embodiment of the present invention.
Figure 2:
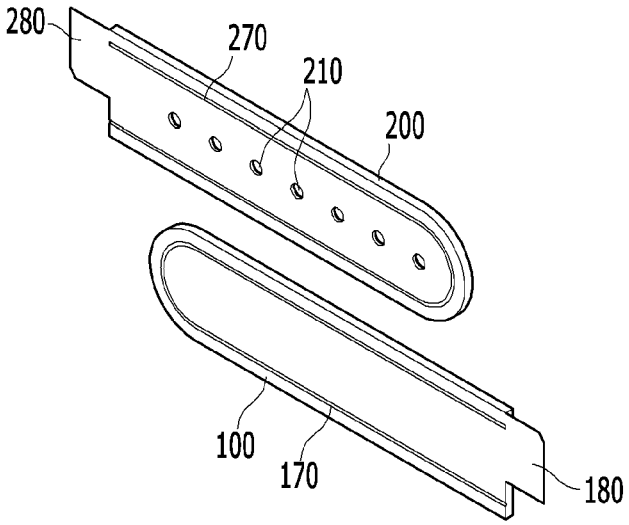
FIG. 2 is a perspective view illustrating an inner side surface of a size adjustment unit for a headwear having high decorativeness according to an exemplary embodiment of the present invention.
Figure 3:
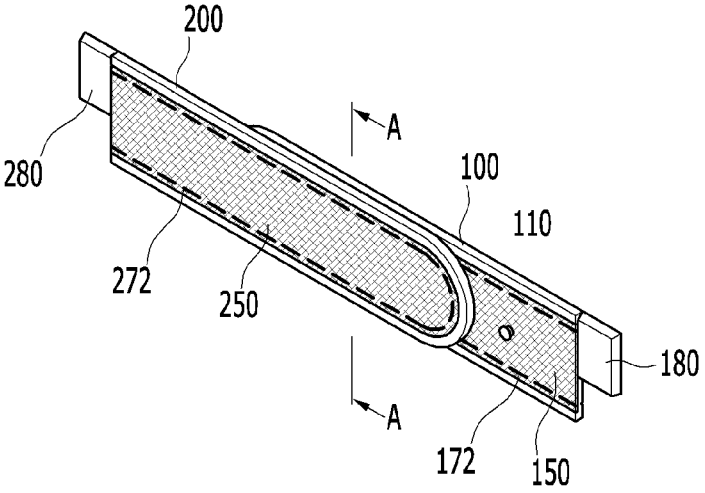
FIG. 3 is a perspective view illustrating a coupled shape of a size adjustment unit for a headwear having high decorativeness according to an exemplary embodiment of the present invention.

FIG. 1 is a perspective view illustrating an outer side surface of a size adjustment unit for a headwear having high decorativeness according to an exemplary embodiment of the present invention, FIG. 2 is a perspective view illustrating an inner side surface of a size adjustment unit for a headwear having high decorativeness according to an exemplary embodiment of the present invention, and FIG. 3 is a perspective view illustrating a coupled shape of a size adjustment unit for a headwear having high decorativeness according to an exemplary embodiment of the present invention. In FIG. 1, a dotted line represents a portion of a headwear to which a headwear size adjustment unit is attached according to an exemplary embodiment of the present invention.

The size adjustment unit for a headwear having high decorativeness according to the present exemplary embodiment includes a first band 100, a first decorative member 150, a second band 200, and a second decorative member 250.

The first band 100 has a plate shape of a predetermined length. The first band 100 may be made of a material having predetermined flexibility. The first band 100 may be made of a plastic material or may be produced by injection molding.

The first band 100 includes a plurality of coupling protrusions 110. The coupling protrusion 110 is formed at an outer surface of the first band 100. The outside means a direction that is viewed from the outside when a user wears the headwear. Hereinafter, the outer surface means a surface that is viewed from the outside when the user wears the headwear to which the first band 100 is attached. However, a portion of the outer surface may be covered by the second band 200 to be described later.

The plurality of coupling protrusions 110 are formed in a line at a predetermined gap in a circumferential direction of the first band 100.

At one end portion of the first band 100 in a circumferential direction, a first headwear connection portion 180 may be formed. The first headwear connection portion 180 is coupled to the lower end of one side of an opening 300 of the headwear. The first band 100 is attached to the headwear by the coupling.

The first decorative member 150 forms a thin plate shape. The first decorative member 150 generally corresponds to a shape of an outer surface of the first band 100 and is produced separately from the first band 100 to be attached to an outer surface of the first band 100.

The first decorative member 150 may be made of a material that may be easily cut and having flexibility. Further, the first decorative member 150 may be made of a material that may be applied with various patterns or colors at a low cost. For example, the first decorative member 150 may be made of fabric, film, leather, artificial leather, rubber, or a silicon material. The above materials may be easily cut, may have flexibility, and may be applied with various patterns or colors on a surface thereof at a low cost. When such a first decorative member 150 is attached to the first band 100, decorativeness of the first band 100 can be improved with a low cost.

The first decorative member 150 may be cut in a desired size by various methods. For the cut, a cutting mold or a laser cutting device may be used. Further, because the first decorative member 150 has a thin plate shape, the first decorative member 150 may be easily cut out with scissors or a knife.

The first decorative member 150 may be attached to the first band 100 by sewing, ultrasonic wave bonding, or high frequency bonding.

When the first decorative member 150 is attached by the sewing, sewing thread 172 may be exposed to the outside in a row of embroidery stitches in various colors. In such a case, decorativeness of the first band 100 can be further improved by the color and the embroidery stitches.

Referring to FIG. 2, at an inner surface of the first band 100, a sewing groove 170 may be formed. Hereinafter, the inner surface means a surface that is not viewed from the outside when a user wears the headwear to which the first band 100 is attached. When the first decorative member 150 is attached to the first band 100 by sewing, the sewing thread 172 that is exposed at an inner surface of the first band 100 is positioned along the inside of the sewing groove 170. Therefore, the sewing thread 172 is not protruded from the inner surface of the first band 100. Thereby, an inner surface of the first band 100 may be formed evenly.

The second band 200 is formed in a plate shape having a predetermined length. The second band 200 is made of a material having predetermined flexibility. The second band 200 may be made of a plastic material and may be produced by injection molding.

The second band 200 includes a plurality of coupling holes 210. The plurality of coupling holes 210 are formed in a line at a predetermined gap in a circumferential direction of the second band 200. The predetermined gap may be the same as a predetermined gap of a plurality of coupling protrusions 110 of the first band 100.

The coupling holes 210 may form a perforated line. However, even in such a case, one side of the coupling holes 210 may be covered with the second decorative member 250 as the second decorative member 250 is mounted on the second band 200.

At one end portion of the second band 200 in a circumferential direction, a second headwear connection portion 280 may be formed. The second headwear connection portion 280 is coupled to the lower end of the other side of the opening 300 of the headwear. The second band 200 is attached to the headwear by the coupling. Further, a headwear size may be adjusted by coupling of the first band 100 and the second band 200.

The second decorative member 250 forms a thin plate shape. The second decorative member 250 generally corresponds to a shape of an outer surface of the second band 200 and is separately produced from the second band 200 to be attached to an outer surface of the second band 200. Hereinafter, the outer surface means a surface that is viewed from the outside when the user wears the headwear to which the second band 200 is attached.

The second decorative member 250 may be made of a material that may be easily cut and having flexibility. Further, the second decorative member 250 may be made of a material that may be applied with various patterns or colors at a low cost. For example, the second decorative member 250 may be made of fabric, film, leather, artificial leather, rubber, or a silicon material. The above materials may be easily cut, may have flexibility, and may be applied with various patterns or colors on a surface thereof at a low cost. When such a second decorative member 250 is attached to the second band 200, decorativeness of the second band 200 can be improved at a low cost.

The second decorative member 250 may be cut in a desired size by various methods. For the cut, a cutting mold or a laser cutting device may be used. Further, because the second decorative member 250 has a thin plate shape, the second decorative member 250 can be easily cut out with scissors and a knife.

The second decorative member 250 may be attached to the second band 200 by sewing, ultrasonic wave bonding, or high frequency bonding.

When the second decorative member 250 is attached by the sewing, sewing thread 272 may be exposed to the outside in a row of embroidery stitches in various colors. In such a case, decorativeness of the second band 200 can be further improved by the color and the embroidery stitches.

Referring to FIG. 2, at an inner surface of the second band 200, a sewing groove 270 may be formed. Hereinafter, the inner surface means a surface that is not viewed from the outside when the user wears the headwear to which the second band 200 is attached. When the second decorative member 250 is attached to the second band 200 by sewing, the sewing thread 272 that is exposed at an inner surface of the second band 200 is positioned along the inside of the sewing groove 270. Therefore, the sewing thread 272 is not protruded from the inner surface of the second band 200. Thereby, the inner surface of the second band 200 may be formed evenly.

Referring to FIG. 3, when the first band 100 and the second band 200 are coupled, the first decorative member 150 that is attached to the first band 100 and the second decorative member 250 that is attached to the second band 200 are exposed to the outside. However, a portion of the first decorative member 150 may be covered by the second band 200.

Figure 4:
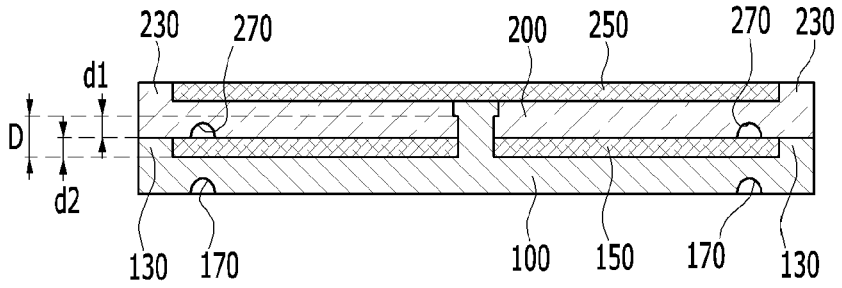
FIG. 4 is a cross-sectional view illustrating the size adjustment unit taken along line A-A of FIG. 3.
Figure 5:
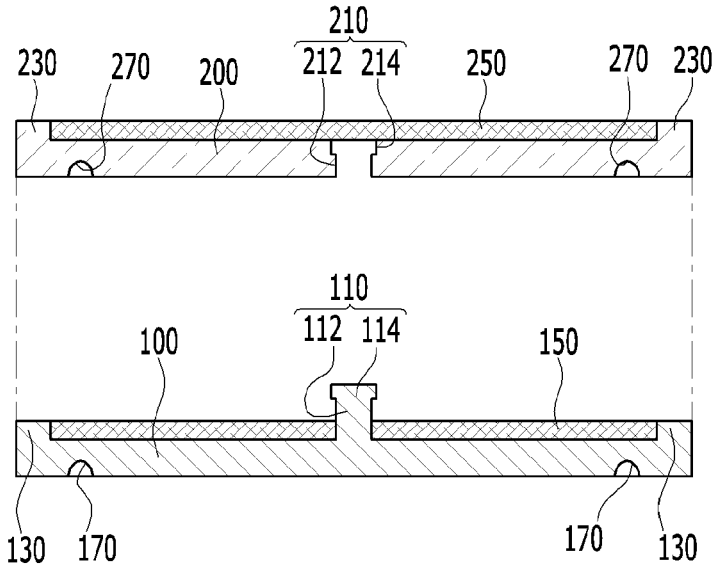
FIG. 5 is a cross-sectional view illustrating a separated shape of a first band and a second band of FIG. 4.

FIG. 4 is a cross-sectional view illustrating the size adjustment unit taken along line A-A of FIG. 3, and FIG. 5 is a cross-sectional view illustrating a separated shape of a first band and a second band of FIG. 4.

The coupling protrusion 110 that is formed at an outer surface of the first band 100 includes a connecting portion 112 and a top portion 114. The connecting portion 112 is extended generally perpendicular to an outer surface of the first band 100. The top portion 114 is formed at an end portion of the connecting portion 112.

The top portion 114 has a shape extending toward an outer side of an outer peripheral surface of the connecting portion 112. The connecting portion 112 may be formed as a circular or polygonal column shape, and the top portion 114 may be formed as a circular or polygonal plate shape.

The coupling hole 210 that is formed in the second band 200 includes an inserting portion 212 and a receiving portion 214. Shape of an interior surface of the inserting portion 212 may correspond to the shape of the connecting portion 112, and shape of an interior surface of the receiving portion 214 may correspond to the shape of the top portion 114.

When the coupling protrusion 110 is inserted into the coupling hole 210, the first band 100 and the second band 200 are coupled. Upon coupling, the inserting portion 212 and the receiving portion 214 contact the connecting portion 112 and the top portion 114, respectively.

A first receiving wall 130 may be formed along a circumferential edge of an outer surface of the first band 100, within which the first decorative member 150 can be situated.

Further, a second receiving wall 230 may be formed along a circumferential edge of an outer surface of the second band 200, within which the second decorative member 250 can be situated.

Height of the first receiving wall 130 for the first decorative member may be generally the same as a thickness of the first decorative member 150, thereby forming no protrusion when the first band 100 and the first decorative member 150 are attached. Therefore, an outer surface of the first band 100 and the first decorative member 150 as attached may be formed evenly.

When the outer surface is evenly formed, the outer surface is entirely in contact with an inner surface of the second band 200 that is plate-shaped. Therefore, the first band 100 and the second band 200 may be more stably coupled.

A length D of the connecting portion 112 may be generally the same as the sum of a depth d1 of the inserting portion 212 and a thickness d2 of the first decorative member 150. In such a case, the inserting portion 212 and the first decorative member 150 may be positioned right between the top portion 114 and the outer surface of the first band 100.

Thereby, the coupling protrusion 110 and the coupling hole 210 may be easily coupled. Conversely, the inserting portion 212 and the first decorative member 150 may not fit into between the top portion 114 and an outer surface of the first band 100 when the sum of a depth d1 of the inserting portion 212 and a thickness d2 of the first decorative member 150 is larger than a length D of the connecting portion 112. Further, the inserting portion 212 and the first decorative member 150 may be loosely fitted between the top portion 114 and the outer surface of the first band 100 if the sum is smaller than the length D of the connecting portion 112.

The first band 100 and the second band 200 each have the first sewing groove 170 and the second sewing groove 270 respectively. Although not shown, sewing stitches may be positioned along the first sewing groove 170 and the second sewing groove 270.

| <Description of symbols> | |
|---|---|
| 100: first band | 110: coupling protrusion |
| 112: connecting portion | 114: top portion |
| 150: first decorative member | 200: second band |
| 210: coupling hole | 212: inserting portion |
| 214: receiving portion | 250: second decorative member |

What is claimed is:

1. A size adjustment unit for a headwear having high decorativeness, the headwear size adjustment unit comprising:

a first band comprising a first outer surface and a first inner surface, and a plurality of coupling protrusions on the first outer surface;

a second band comprising a second outer surface and a second inner surface, and a plurality of coupling holes arranged on the second inner surface at a predetermined interval to correspond to the coupling protrusions;

a first decorative member that is attached to the first outer surface of the first band; and a second decorative member that is attached to the second outer surface of the second band, wherein the second band includes a first receiving wall formed on the second outer surface along a circumferential edge of the second outer surface, wherein the first receiving wall forms a first groove along with the second outer surface, wherein the second decorative member is received in the first groove to cover the plurality of coupling holes and surrounded by the first receiving wall, and wherein the first decorative member and the second decorative member are attached to the first band and the second band, respectively by sewing, ultrasonic wave bonding, or high frequency bonding.

2. The headwear size adjustment unit of claim 1, wherein the first decorative member or the second decorative member is made of fabric, film, leather, artificial leather, rubber, or a silicon material.

3. The headwear size adjustment unit of claim 1, wherein the first band includes a second receiving wall formed on the first outer surface along a circumferential edge of the first outer surface, wherein the second receiving wall forms a second groove along with the first outer surface, and wherein the first decorative member is received in the second groove and surrounded by the second receiving wall.

4. The headwear size adjustment unit of claim 3, wherein a height of the second receiving wall formed on the first band is generally the same as a thickness of the first decorative member.

5. The headwear size adjustment unit of claim 1, wherein each of the plurality of coupling protrusions comprises a top portion and a connecting portion, each of the plurality of coupling holes comprises an inserting portion and a receiving portion, and a length of the connecting portion is generally the same as the sum of a depth of the inserting portion and a thickness of the first decorative member.

6. The headwear size adjustment unit of claim 1, wherein the first band and the second band have a sewing groove on each inner surface.

* * * * *